United States Patent [19]

Wang

[11] 4,034,863

[45] July 12, 1977

[54] NOVEL FLOTATION AGENTS FOR THE BENEFICIATION OF PHOSPHATE ORES

[75] Inventor: Samuel Shan Ning Wang, Cheshire, Conn.

[73] Assignee: American Cyanamid Company, Stamford, Conn.

[21] Appl. No.: 642,937

[22] Filed: Dec. 22, 1975

[51] Int. Cl.[2] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 2,099,120 | 11/1937 | Kirby | 209/166 |
| 2,120,217 | 6/1938 | Harris | 209/166 |
| 2,302,338 | 11/1942 | Mueller | 209/166 |
| 2,312,466 | 3/1943 | Erickson | 209/166 |
| 2,362,432 | 11/1944 | Cahn | 209/166 |
| 2,950,818 | 8/1960 | Mueller | 209/166 |
| 3,779,380 | 12/1973 | Bishop | 209/166 |
| 3,902,602 | 9/1975 | Petrovich | 209/166 |
| 3,909,399 | 9/1975 | Petrovich | 209/166 |

FOREIGN PATENT DOCUMENTS

| | | | |
|---|---|---|---|
| 1,355,091 | 5/1974 | United Kingdom | 209/166 |

*Primary Examiner*—Robert Halper
*Attorney, Agent, or Firm*—William J. Loo

[57] ABSTRACT

Partial esters of polycarboxylic acids having the structure

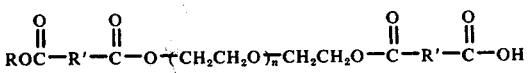

wherein R is the radical remaining after removal of the hydroxyl group of a straight chain linear aliphatic alcohol having 12–22 carbon atoms, *n* is a number of 0–5, and R′ is a specified bivalent grouping which are effective collectors for non-sulfide minerals in froth flotation.

5 Claims, No Drawings

NOVEL FLOTATION AGENTS FOR THE BENEFICIATION OF PHOSPHATE ORES

This invention relates to an improved process of mineral beneficiation by froth flotation. More particularly, the invention relates to such a process wherein non-sulfide minerals such as phosphate, fluorite, and barite are processed by froth flotation using as collector one of certain novel glycol partial esters of polycarboxylic acids.

Froth flotation is the principal means of concentrating phosphate, barite, and fluorite ores as well as a host of other ores. Its chief advantage is that it is a relatively efficient operation at a substantially lower cost than many other processes.

Flotation is a process for separating finely ground valuable minerals from their associated gangue, or waste, or for separating valuable components one from the other. In froth flotation, frothing occurs by introducing air into a pulp of finely divided ore and water containing a frothing agent. Minerals that have a special affinity for air bubbles rise to the surface in the froth and are separated from those wetted by the water. The particles to be separated by froth flotation must be of a size that can be readily levitated by the air bubbles.

Agents called collectors are used in conjunction with flotation to promote recovery of the desired material. The agents chosen must be capable of selectively coating the desired material in spite of the presence of many other mineral species. Current theory states that the flotation separation of one mineral species from another depends on the relative wettability of surfaces. Typically, the surface free energy is purportedly lowered by the adsorption of heteropolar surface-active agents. The hydrophobic coating thus provided acts in this explanation as a bridge so that the particle may be attached to an air bubble. The practice of this invention is not limited by this or other theories of flotation.

Typically, phosphate ore containing about 15–35% BPL (bone phosphate of lime) $ca_3(PO_4)_2$, is concentrated in very large tonnages from the Florida pebble phosphate deposits. The ore slurry from strip mining is sized at about 1 millimeter and the coarser fraction, after scrubbing to break up mud balls, is a finished product. The minus 1 mm. fraction is further sized at 35 and 200 mesh. The minus 200 mesh slime is discarded. In some operations the +35 mesh material in thick slurry is treated with fatty acid, fuel oil, and caustic, ammonia, or other alkaline material and the resulting agglomerates are separated on shaking tables, spirals, or spray belts. The 35 × 200 mesh fraction is conditioned with the same type of reagents and floated by conventional froth flotation route. Not all the silica gangue is rejected by the fatty acid flotation, so the concentrate is blunged with acid to remove collector coatings, deslimed, washed of reagents and subjected to an amine flotation with fuel oil at pH 7–8. This latter flotation, sometimes called "cleaning." removes additional silica and raises the final concentrate grade to 75–80% BPL.

Although the procedure described above is effective in the recovery of BPL from phosphate rock, there nevertheless exists the need for more effective collectors which will provide increased recovery of phosphorous values while still providing high grade recovery. In view of the high quantities of phosphate rock processed by froth flotation, such a development can result in a substantial increase in the total amount of phosphorus values recovered and provide substantial economic advantages even when a modest increase in recovery is provided. Accordingly, the provisin for an improved process for froth flotation of non-sulfide minerals would fulfill a long-felt need and constitute a notable advance in the art.

In addition, the acids currently employed are derived from vegetable oils, which represent scarce edible oil stock used for nutritional purposes. Provision for a froth flotation process based on acids that are more abundantly available and are not derived from the scarce natural oil stocks would give rise to an abundant source for useful acids and free the natural oils for preferred purposes. The provision of itself is a significant contribution to the art in view of the continuing and ever-increasing scarcity of natural oil stocks.

Because of the scarcity of the naturally derived acids conventionally employed in the froth flotation of non-sulfide minerals, there has been much activity to provide alternative acids that would release the natural oil stocks for preferred purposes while providing synthetic acids that would provide good performance in froth flotation. Certain acids that have been provided are partial esters of polycarboxylic acids wherein the esterifying group is an ethoxylated alcohol. Such partial esters cause excessive foaming in froth flotation. This excessive foaming is believed to arise from the fact that the ethoxylated alcohols represent mixtures of compounds of varying degrees of ethoxylation. Fractionation of the ethoxylated alcohols is expensive to achieve and can lead to decomposition. Use of such acids in froth flotation can require the added use of defoamers which add to treatment costs.

In accordance with the present invention, there is provided a process for recovering non-sulfide minerals which comprises classifying the mineral to provide particles of flotation size, slurrying the sized mineral in aqueous medium, conditioning the slurry with effective amounts of fuel oil, alkali, and a partial ester of a polycarboxylic acid having at least one free carboxylic acid group, and floating the desired mineral values by froth flotation, said partial ester having the structure

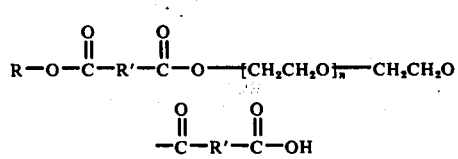

wherein R is the radical remaining after removal of the hydroxyl group from a straight chain linear aliphatic alcohol of 12 to 22 carbon atoms, $n$ is a number of 0–5, and R′ is a bivalent grouping selected from $-(CH_2)_m$ wherein $m$ is a number of 1-6,

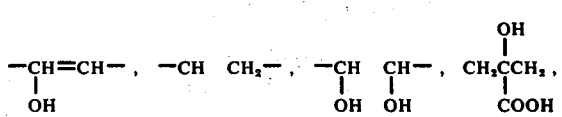

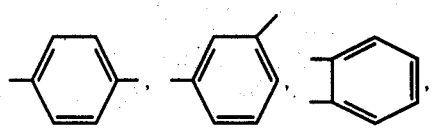

-continued

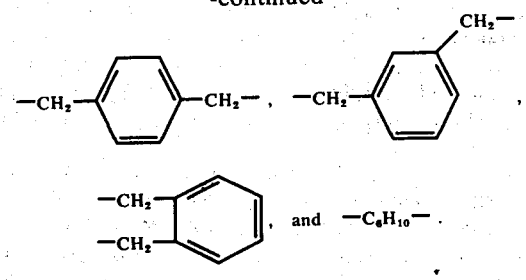

There is also provided a partial ester of a polycarboxylic acid having the structure

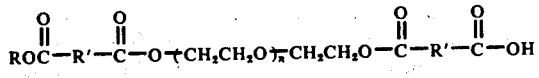

wherein R, $n$, and R′ have the significance previously given.

Use of the specified acids provides good recovery of valuable minerals at high grade, or purity, levels under normal froth flotation conditions. These acids are readily degraded to permit recycle of process streams. The present acids are readily dispersed in aqueous systems providing efficient coverage of the mineral surface. The acids are stable for practical periods under froth flotation conditions. The acids resist deposition and inactivation by normal or excessive water hardness ions such as soluble calcium and magnesium compounds (carbonates, bicarbonates, hydroxides, etc.). The acids do not present excessive foaming problems.

The acids used in the present process are provided by synthesis utilizing specific polycarboxylic acids and esterifying agents. These synthetic acids are moderate in cost, provide greater recovery of usable mineral per unit cost, and are more readily available than currently used reagents. The synthetic acids can be produced in more consistent, predictable purity and quality than naturally derived, scarce products. The acids of the present invention will release scarce natural oil stocks for preferred purposes.

In preparing the acids of the present invention, the following reaction scheme is employed:

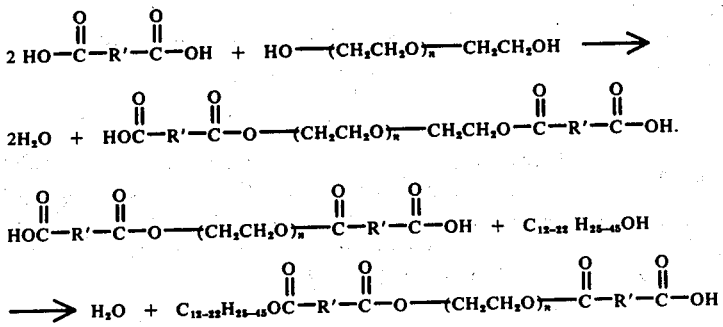

wherein R′ and $n$ are as indicated above. Preferably R′ is —CH=CH—, $n$ is 0–3, and R is an alcohol having a number average of 12–14 carbon atoms. The reactions are carried out at a temperature in the range of about 60°–180° C. under typical esterification conditions. In step I of the reaction, it is preferable to use maleic acid anhydride. The reactions are typical esterification reactions and merely involve specified reactants to provide the novel acids.

In carrying out the froth flotation process of the present invention, a non-sulfide mineral is selected for treatment. Such minerals include phosphate, fluorite, barite, and the like that are conventionally processed by froth flotation. The selected mineral is screened to provide particles of flotation size according to conventional procedures. Generally, the flotation size will encompass from about 35 × 150 mesh size.

After the selected mineral has been sized as indicated, it is slurried in aqueous medium and conditioned with acid, fuel oil, and alkali in effective amounts in accordance with conventional procedures. Generally, the slurry is conditioned at pasty consistency in the range of about 50 to 75% solids, preferably 65–70% solids. Generally, the acid and fuel oil are used as a mixture in the ratio from about 2/1 to 1/4 acid/oil such as to provide a level of about 0.1 to 2.0 lbs. of acid per tone of mineral, although variations in amounts will vary with the specific mineral being processed within conventional ranges. The fuel oil normally serves as a promoter extender. It is also used sometimes to suppress excessive froth formation and will vary as necessary depending upon the extent to which frothing occurs.

Alkali usage will be within conventional limits and is that necessary to provide the pH value at which froth flotation is to be accomplished. The pH value is generally on the alkaline side but specific values will vary depending upon the mineral processed and the combination of recovery and grade desired. Generally the pH will range from about 6.0 to 12.0, usually 8.0 to 10.0.

As the acid used in accordance with the present invention, there is employed one having the general structure

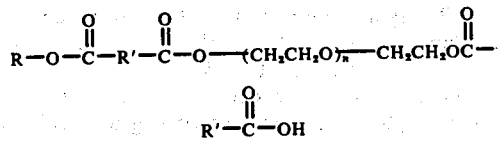

wherein R is the radical remaining after removal of the hydroxyl group from a linear straight-chain aliphatic alcohol of 12 to 22 carbons, n is a number from 0 to 5, and R′ is a bivalent grouping selected from $-(CH_2)_m-$ wherein m is an integer of 1 to 6,

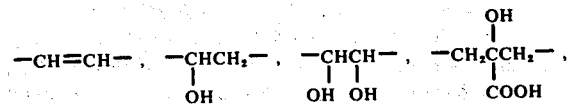

-continued

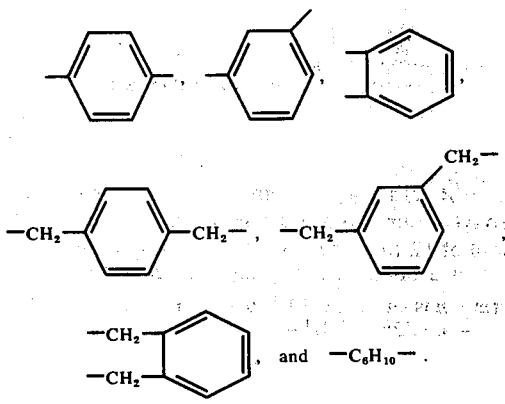

A preferred acid is maleic acid. A preferred alcohol is one in which the number average of carbon atoms is 12–14. A convenient source of alcohols is a mixture of alcohols wherein individual species present have varying length carbon chains, the number average of which is as indicated. By the number average is meant that the total composition of species is such as to provide an average number as indicated. The preferred value for $n$ is 0 to 3. Preferred partial ester acid species of the present invention include the following

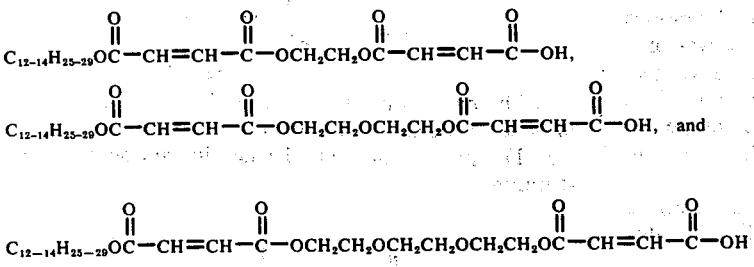

Suitable non-sulfide minerals processed by the process of the present invention includes fluorite or fluorspar, barite or barytes, phosphate rock of the pebble type as found in Florida or foskorite as found in South Africa. Other non-sulfide minerals that are processed by froth flotation using an acid collector may also be processed.

The invention is more fully illustrated in the examples which follow, wherein all parts and percentages are by weight unless otherwise specified. Although the invention is illustrated with phosphate minerals, it is to be understood that similar benefits are obtainable with other minerals as defined. The following general procedure is employed in the froth flotation examples given:

GENERAL PROCEDURE

Rougher Float

Step 1: Secure washed and sized feed, e.g., 35 × 150 mesh screen fractions. Typical feed is usually a mixture of 23% coarse with 77% fine flotation particles.

Step 2: Sufficient wet sample, usually 640 grams, to give a dry weight equivalent of 500 grams. The sample is washed once with about an equal weight of tap water. The water is carefully decanted to avoid loss of solids.

Step 3: The moist sample is conditioned for 1 minute with approximately 100 cc of water, sufficient caustic as 5–10% aqueous solution to obtain the pH desired, a mixture of 50% acid and suitable fuel oil and additional fuel oil as necessary. Additional water may be necessary to give the mixture the consistency of "oatmeal" (about 69% solids). The amount of caustic will vary from about 4 to about 20 drops. This is adjusted with a pH meter for the correct end point. At the end of the conditioning, additional caustic may be added to adjust the end point. However, an additional 15 seconds of conditioning is required if additional caustic is added to adjust the pH. Five to about 200 drops of acid-oil mixture and one-half this amount of additional oil is used, depending upon the treatment level desired.

Step 4: Conditioned pulp is placed in an 800-grain bowl of a flotation machine and approximately 2.6 liters of water are added (enough water to bring the pulp level to lip of the container). The percent solids in the cell is then about 14%. The pulp is floated for 2 minutes with air introduced after 10 seconds of mixing. The excess water is carefully decanted from the rougher products. The tails are set aside for drying and assay.

Step 5 : The products are oven dried, weighed, and analyzed for weight percent $P_2O_5$ or BPL. Recovery of mineral values is calculated using the formula:

$$\frac{(W_c)(P_c)}{(W_c)(P_c) + (W_t)(P_t)} \times 100$$

wherein $W_c$ and $W_t$ are the dry weights of concentrate and tailings, respectively, and $P_c$ and $P_t$ are the weight percent $P_2O_5$ or BPL of the concentrate and tails, respectively.

EXAMPLE 1

Preparation of

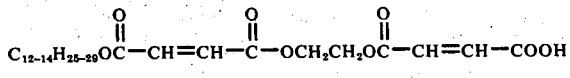

To 62.07 grams (1 mole) of ethylene glycol are added 196.12 grams (2 moles) of maleic anhydride. The mixture is heated to 120° C. and reacted at that temperature until reaction is complete, about 4 hours. To the reaction mixture are then added 205.41 grams (1 mole) of a linear straight chain alcohol having a number average of carbon atoms equal to 13.36. The reaction mixture is heated to 155°– 160° C. and reacted at that temperature until reaction is complete, about 4 hours. The reaction product is the half ester of the structure given above.

EXAMPLE 2

Preparation of

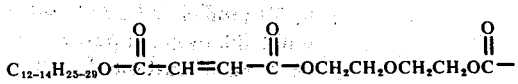

-continued $$CH{=}CH{-}\overset{O}{\overset{\|}{C}}{-}OH.$$

The procedure of Example 1 is again followed in every material detail except that in place of ethylene glycol, there is employed 106.12 grams (1 mole) of diethylene glycol. The reaction product is the half ester of the structure given above.

EXAMPLE 3

Preparation of $$C_{13-14}H_{25-29}O\overset{O}{\overset{\|}{C}}{-}CH{=}CH{-}\overset{O}{\overset{\|}{C}}{-}$$

$$OCH_2CH_2OCH_2CH_2OCH_2CH_2O\overset{O}{\overset{\|}{C}}{-}CH{=}CH{-}\overset{O}{\overset{\|}{C}}{-}OH$$

The procedure of Example 1 is again followed in every material detail except that in place of ethylene glycol, there is employed 150.18 grams of triethylene glycol. The reaction product is the half ester of the structure given above.

EXAMPLE 4

Flotation of Florida Phosphate

Using as collectors the half acid esters of Examples 1–3 in separate runs, Flordia phosphate rock was processed according to the General Procedure described above. Caustic usage was that necessary to provide a pH value of 9.55. Acid and Fuel Oil (No. 5) usage are given in the accompanying table which also gives the results of the froth flotations.

For comparison purposes, runs were made using in one run stearic acid and in another a half acid ester using as the glycol, one having the formula $$H(OCH_2CH_2)_nOCH_2CH_2\text{-}OH$$

wherein $n$ is a value of about 7.75. Results obtained with the comparative examples are also given in the table.

| Acid of Example | Glycol Used | Dosage Acid | (Lbs/Ton) Fuel Oil | Phosphate Rock Froth Flotation Conc. (Weight %) | Conc. (% B.P.L.) | Tail (% B.P.L.) | Feed (% B.P.L.) | Recovery (% B.P.L.) |
|---|---|---|---|---|---|---|---|---|
| 1 | Ethylene | 0.385 | 0.385 | 26.11 | 59.54 | 6.21 | 20.14 | 76.04 |
| 1 | Ethylene | 0.909 | 0.909 | 33.83 | 55.96 | 1.64 | 20.02 | 94.58 |
| 2 | Diethylene | 0.425 | 0.425 | 27.65 | 61.53 | 3.71 | 19.69 | 86.37 |
| 2 | Diethylene | 0.846 | 0.846 | 32.23 | 57.51 | 1.64 | 19.65 | 94.34 |
| 3 | Triethylene | 0.426 | 0.426 | 24.31 | 62.84 | 4.76 | 18.88 | 80.08 |
| 3 | Triethylene | 0.840 | 0.840 | 27.44 | 66.88 | 2.08 | 19.86 | 92.40 |
| Comparative (Tall Oil Fatty Acid) | | 1.30 | 2.60 | 30.17 | 64.26 | 2.84 | 21.37 | 90.72 |
| Comparative 400 MW | | 1.026 | 1.026 | 4.5 | — | — | — | — |

In the last run, a great excess of foam arose, which was objectionable, while no foam problem occurred in the other runs.

I claim:

1. A process for recovering non-sulfide minerals which comprises classifying the mineral to provide particles of flotation size, slurrying the sized mineral in aqueous medium, conditioning the slurry with effective amounts of fuel oil, alkali, and a partial ester of a polycarboxylic acid having at least one free carboxylic acid group, and floating the desired mineral values by fourth flotation, said partial ester having the structure $$R{-}O{-}\overset{O}{\overset{\|}{C}}{-}R'{-}\overset{O}{\overset{\|}{C}}{-}O{-}(CH_2CH_2O)_n{-}CH_2CH_2O{-}\overset{O}{\overset{\|}{C}}{-}R'{-}\overset{O}{\overset{\|}{C}}{-}OH$$

wherein R is the radical remaining after removal of the hydroxyl group from a straight chain linear aliphatic alcohol of 12 to 22 carbon atoms, $n$ is a number of 0-5, and R′ is a bivalent grouping selected from $-(CH_2)_m$ wherein $m$ is a number of 1–6, —CH=CH—, —CHOH-CH—, —CHOHCHOH—,

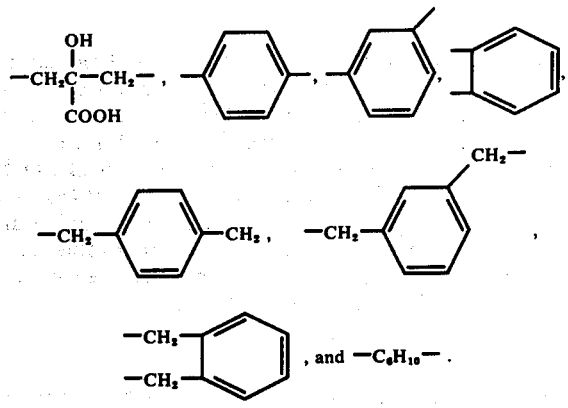

2. The process of claim 1 wherein said classification provides particles in the range of 35 × 200 mesh.

3. The process of claim 1 wherein said acid has the structure $$C_{13.36}H_{27.72}O\overset{O}{\overset{\|}{C}}{-}CH{=}CH{-}\overset{O}{\overset{\|}{C}}{-}OCH_2CH_2O{-}\overset{O}{\overset{\|}{C}}{-}CH{=}CH{-}\overset{O}{\overset{\|}{C}}{-}OH.$$

4. The process of claim 1 wherein said acid has the structure $$C_{13.36}H_{27.72}O\overset{O}{\overset{\|}{C}}{-}CH{=}CH{-}\overset{O}{\overset{\|}{C}}{-}OCH_2CH_2OCH_2CH_2O{-}\overset{O}{\overset{\|}{C}}{-}CH{=}CH{-}\overset{O}{\overset{\|}{C}}{-}OH.$$

5. The process of claim 1 wherein said acid has the structure $$C_{13.36}H_{27.72}OC(=O)-CH=CH-C(=O)-OCH_2CH_2O-$$

-continued $$-CH_2CH_2OCH_2CH_2O-C(=O)-CH=CH-C(=O)-OH.$$

* * * * *